US010107596B2

(12) United States Patent
Greenwood

(10) Patent No.: US 10,107,596 B2
(45) Date of Patent: Oct. 23, 2018

(54) PICATINNY RAIL SEGMENT

(71) Applicant: Timothy L. Greenwood, Hays, KS (US)

(72) Inventor: Timothy L. Greenwood, Hays, KS (US)

( * ) Notice: Subject to any disclaimer, the term of this patent is extended or adjusted under 35 U.S.C. 154(b) by 0 days.

(21) Appl. No.: 15/821,202

(22) Filed: Nov. 22, 2017

(65) Prior Publication Data

US 2018/0094904 A1 Apr. 5, 2018

Related U.S. Application Data

(60) Provisional application No. 62/435,742, filed on Dec. 17, 2016.

(51) Int. Cl.
*F41G 1/38* (2006.01)
*F41G 11/00* (2006.01)

(52) U.S. Cl.
CPC ..... *F41G 11/003* (2013.01)

(58) Field of Classification Search
CPC ..... F41G 11/003; F41C 23/16; F41C 27/00
USPC ..... D22/108, 109, 110
See application file for complete search history.

(56) References Cited

U.S. PATENT DOCUMENTS 7,216,451 B1 * 5/2007 Troy ..... F41C 23/16 42/71.01
8,104,218 B2 * 1/2012 McCann ..... F41G 1/033 42/111
8,196,329 B1 * 6/2012 Mossie ..... F41G 11/003 248/245
8,201,353 B1 * 6/2012 Swan ..... F41C 23/16 42/71.01
2009/0038198 A1 * 2/2009 Yu ..... F41G 11/003 42/90
2013/0180145 A1 * 7/2013 Behling ..... F41A 3/66 42/16

FOREIGN PATENT DOCUMENTS

WO WO-2012138695 A1 * 10/2012 ..... F41G 11/003

* cited by examiner

*Primary Examiner* — Gabriel J. Klein
(74) *Attorney, Agent, or Firm* — Kenneth H. Jack; Davis & Jack, L.L.C.

(57) ABSTRACT

A segment of a Picatinny rail, the Picatinny rail having front and rear ends, left and right sides, and upper and lower sides, the segment of the Picatinny rail having a left V ridge having a front end and a rear end; having a right V ridge having a front end and a rear end; having a front V ridge spanning between the front ends of the left and right V ridges; and having a rear V ridge spanning between the rear ends of the left and right V ridges.

13 Claims, 12 Drawing Sheets

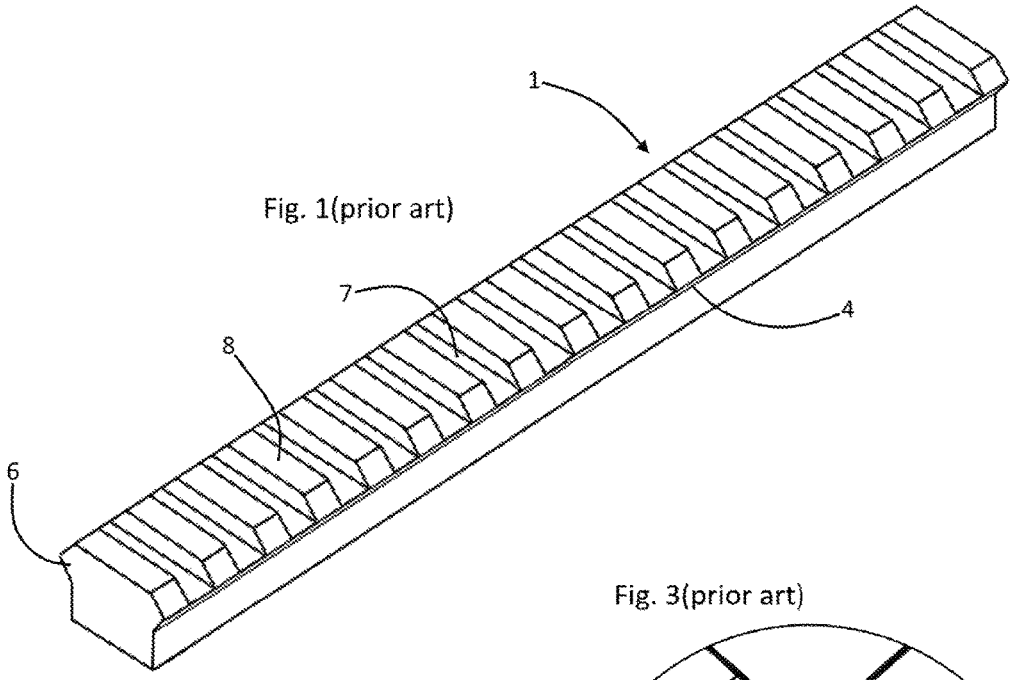
Fig. 1(prior art)
Fig. 3(prior art)
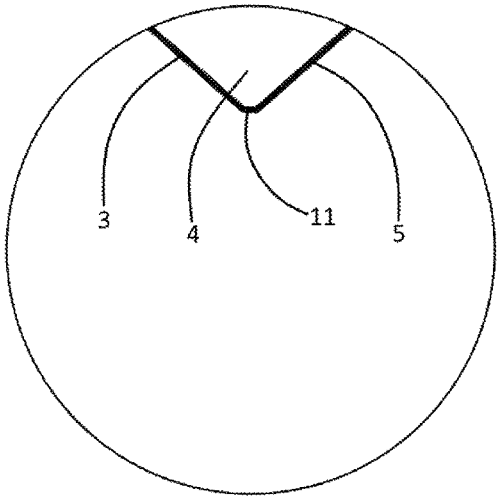
Fig. 2(prior art)
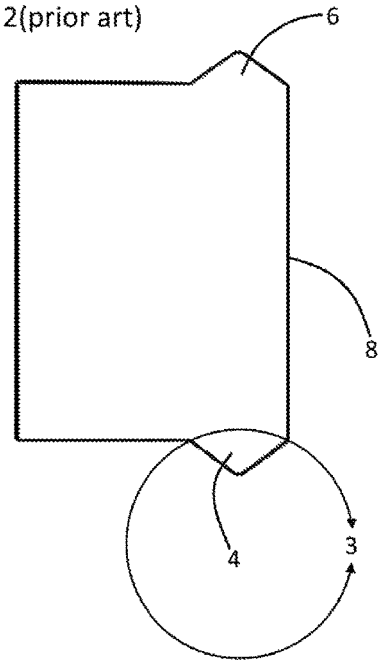

PICATINNY RAIL SEGMENT

CLAIM OF PRIORITY FROM PREVIOUSLY FILED PROVISIONAL PATENT APPLICATION

This non-provisional patent application claims the benefit of and priority from U.S. Provisional Patent Application No. 62/435,742 filed Dec. 17, 2016. The inventor and applicant disclosed in said provisional application are the same as the inventor and applicant of the instant application. Structures and functions of structures disclosed and described in the instant application are substantially identical to those disclosed in said provisional application.

FIELD OF THE INVENTION

This invention relates to tactical firearms in the nature of rifles, shotguns, and pistols. More particularly, this invention relates to fastening assemblies which are adapted for mounting auxiliary components or accessories upon such firearms.

BACKGROUND OF THE INVENTION

Picatinny rails, also known as MIL-STD-1913 rails, are commonly mounted upon a tactical rifle to serve as an auxiliary component fastener. Picatinny rails functionally serve as a standardized mounting platform which commonly consists of a longitudinally extending (with respect to the longitudinal extension of a gun barrel) series of laterally oblongated ridges or "T" arms. To enhance their capacity for locking engagements with various types of mounting brackets, such ridges are commonly separated by multiple transverse slots or channels.

Known Picatinny rail assemblies are designed to mount heavy gun sights of various kinds. A great variety of other accessories or auxiliary components, such as laser illuminators, night vision devices, gun sling mounts, electro-optical image intensifiers, hand grips, video cameras, and bipod muzzle supports are also known to be mounted upon a firearm via an attached Picatinny rail.

A drawback or disadvantage of known Picatinny rail assemblies arises from the fact that their laterally extending ridges or "T" arms typically restrict the mounted orientation of an attached auxiliary component. Since a conventional Picatinny rail presents only two laterally opposing surfaces (e.g., the rail's left and right "T" arms) which may be grasped in the manner of a caliper engagement, auxiliary components which are upon a conventional Picatinny rail may be oriented in only two directions which are 180° removed from each other. Such component orientation restriction is acceptable for auxiliary firearm components whose function is closely related to the longitudinal or forward firing direction of the weapon. For example, auxiliary gun sights are always compatibly mounted upon a conventional Picatinny rail which is mounted upon and extends longitudinally along the firearm's barrel or breech. However, other auxiliary components such as gun slings and their clip mounts and video cameras not necessarily oriented in accordance with the longitudinal sight line or firing direction of the weapon. For such auxiliary components, the 180° orientation restrictions imposed by conventional Picatinny rails are often undesirable and are unduly restrictive.

The instant inventive Picatinny rail segment solves or ameliorates the above described problems, defects, and deficiencies of conventional Picatinny rails, by specially configuring a Picatinny rail segment to present additional and specially oriented V arm components.

BRIEF SUMMARY OF THE INVENTION

The instant invention comprises a segment of a Picatinny rail. Similarly with conventional Picatinny rails and their longitudinally extending segments, the instant inventive Picatinny rail segment has front and rear ends, left and right sides, and upper and lower sides. Also similarly with conventional Picatinny rail segments, the instant inventive Picatinny rail segment has leftwardly extending and rightwardly extending "T" arms which form left and right V ridges. According to the modification of the instant invention, a segment of a Picatinny rail is specially configured to further comprise a front or frontwardly extending V ridge, and a rear or rearwardly extending V ridge. In the preferred embodiment, the front V ridge spans laterally or in the leftward to rightward direction between front ends of the left and right V ridges, and the invention's rear V ridge similarly laterally spans between the rearward ends of such left and right V ridges.

The instant invention's addition of such front and rear V ridges advantageously allows auxiliary component fastening brackets (e.g., caliper brackets) to be more usefully attached to a firearm. According to the invention, such caliper brackets (which according to convention could only be mounted in two orientations removed 180° from each other) are advantageously selectively installable in any of four different orientations which are removed 90° from each other.

For example, where an auxiliary firearm component such as gun sling caliper clip is engaged with the instant inventive Picatinny rail segment, the extension of the sling from the clip mount may be advantageously selected among four different directions to variably facilitate a leftward sling extension, a rightward sling extension, a frontward sling extension, and a rearward sling extension. In another example, where the attached auxiliary component comprises a video camera, the instant inventive Picatinny rail segment advantageously facilitates selective and alternative attachment positions allowing alternative forward viewing and 90° leftward or rightward viewing around corners.

Accordingly, objects of the instant invention include the provision of a Picatinny rail segment which incorporates structures, as described above, and which arranges such structures in relation to each other for the achievement of the beneficial functions described above.

Other and further objects, benefits, and advantages of the instant invention will become known to those skilled in the art upon review of the Detailed Description which follows, and upon review of the appended drawings.

BRIEF DESCRIPTION OF THE DRAWINGS

FIG. 1 depicts a prior art Picatinny rail.

FIG. 2 presents a front end view of the structure of FIG. 1, such end view being rotated 90°.

FIG. 3 is a partial and magnified view of the structure of FIG. 2, as indicated in FIG. 2.

DETAILED DESCRIPTION OF A PREFERRED EMBODIMENT

Figure 4:
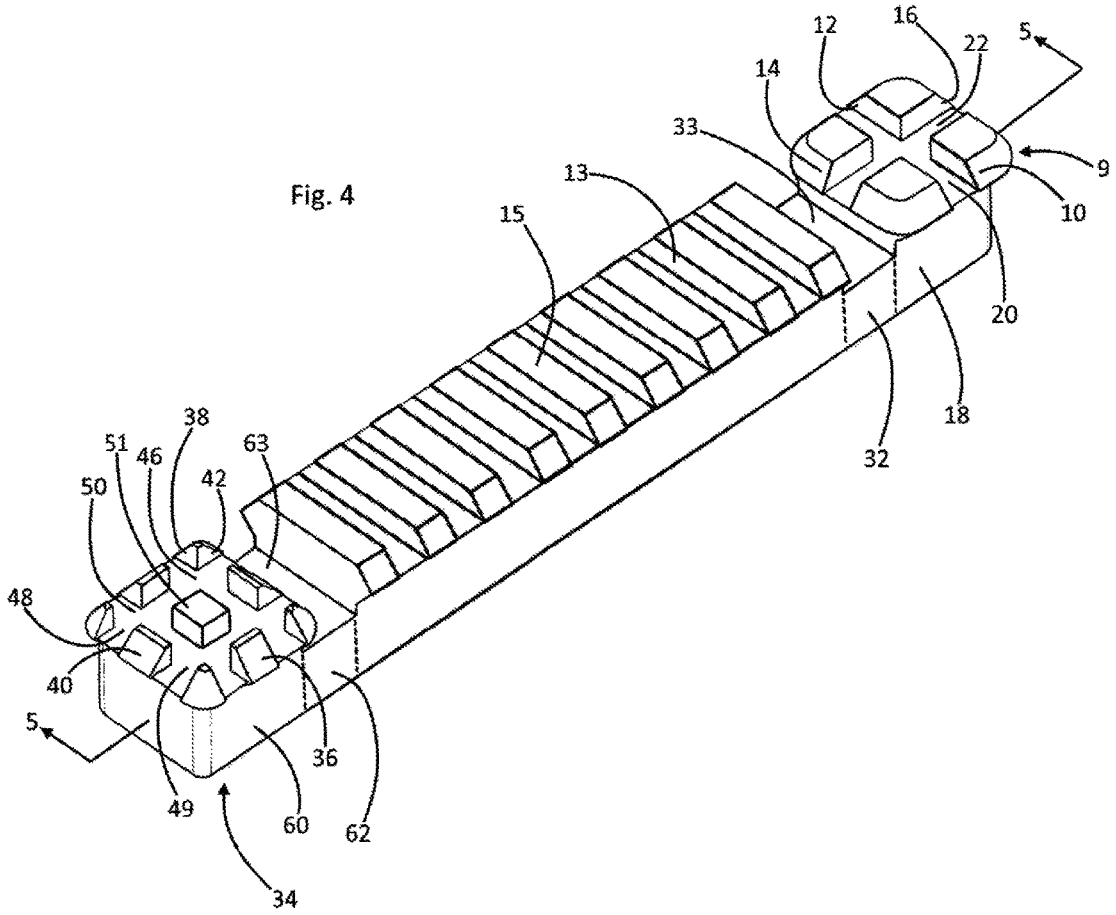
FIG. 4 presents a perspective view of two alternatively configured versions of the instant inventive Picatinny rail segment.
Figure 5:
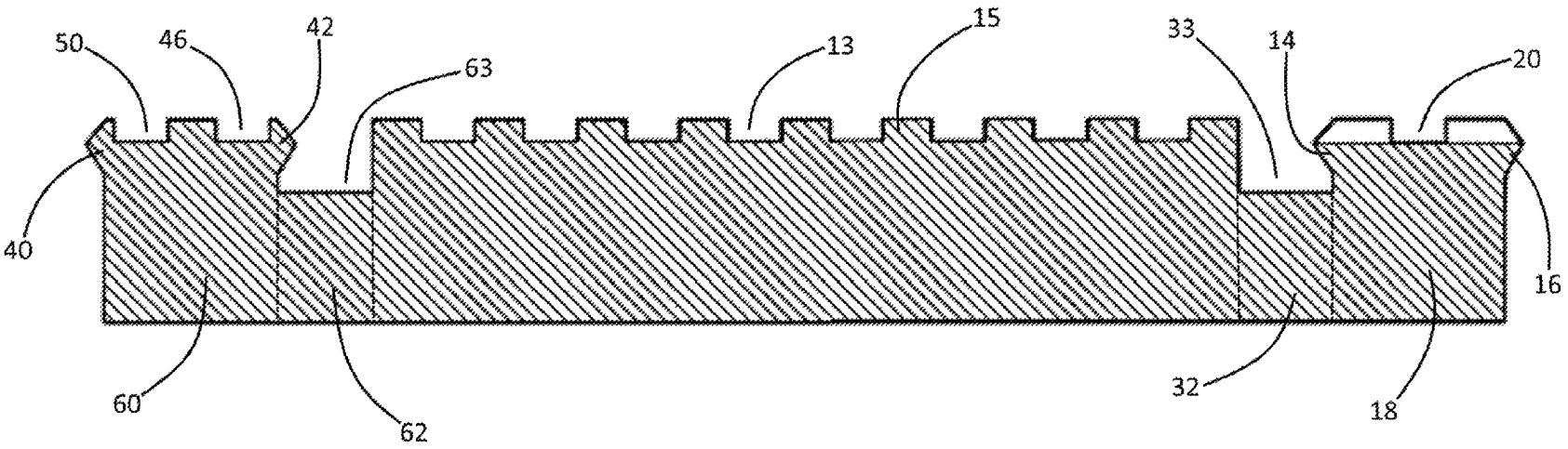
FIG. 5 is a sectional view, as indicated in FIG. 4.
Figure 6:
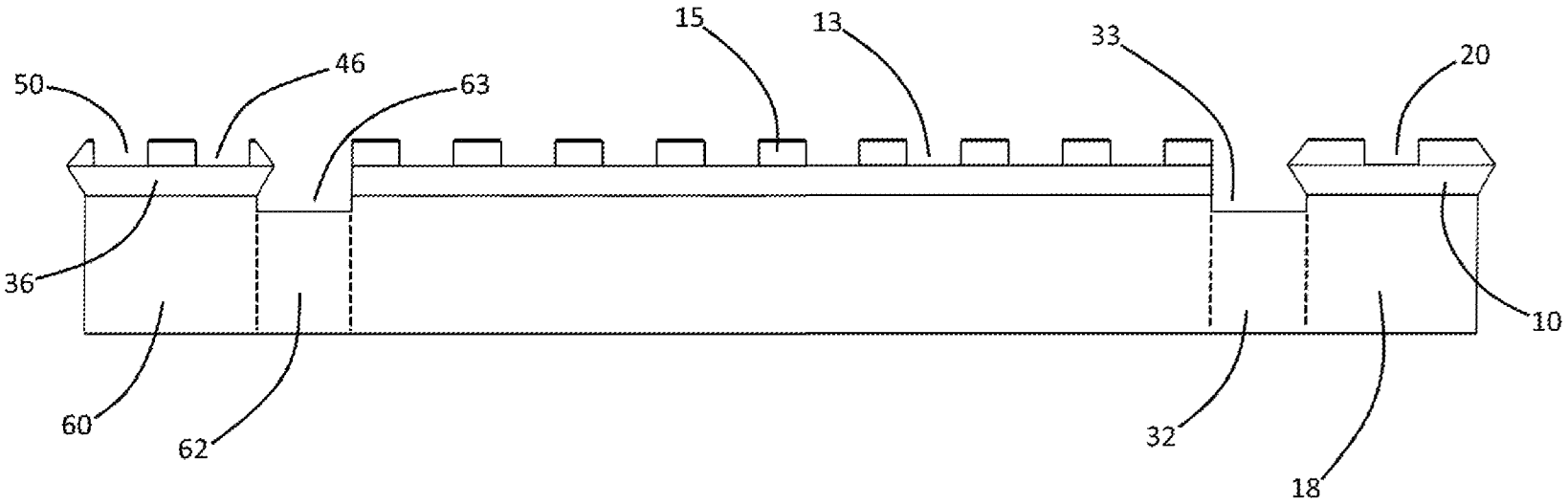
FIG. 6 is a side view of the structure of FIG. 4.

Referring now to the drawings, and in particular to Drawing FIGS. 1-3, a prior art Picatinny rail is presented, such rail being referred to generally by Reference Arrow 1. The prior art rail 1 has "T" shaped lateral cross-sectional profile including a left "T" arm 4 which is shown rotated 90° downwardly in FIGS. 2 and 3. In such rotated orientation, "T" arm 4 presents leftwardly and rightwardly angled faces 3 and 5, and as is indicated in FIG. 3, such faces 3 and 5 form or are configured in accordance with the structure of a common capital letter V whose left and right arms meet at a lower vertex 11. Such specially configured left and right "T" arms 4 and 6 of the conventional Picatinny rail 1 are hereinafter described as V arms.

The prior art Picatinny rail 1 comprises a longitudinally extending (or front to rear extending) series of laterally oblongated ridges 8, such ridges being separated by multiple upwardly opening channels 7. In a common MIL-STD-1913 standardized configuration of the prior art Picatinny rail 1, the ridges 8 have a height of approximately 0.118 inches, and each ridge 8 has a longitudinal or front to rear dimension of 0.18 inches. Under the MIL-STD-1913 standard, the conventional rail has a lateral or left to right dimension or displacement of the vertices or distal ends of the V arms 4 and 6 of approximately 0.835 inches.

Firearm auxiliary component mounting brackets of the types depicted in Drawing FIGS. 9-18 are commonly utilized to engage the laterally opposed V arms 4 and 6 of a conventional Picatinny rail, such engagement being in the manner of a caliper clamp. Such mounting brackets typically have no capacity or capability to otherwise or differently engage the Picatinny rail 1. Accordingly, such mounting brackets typically, and often undesirably, restrict the orientation of a mounted component to a selection among two directions which are 180° removed from each other.

Referring to FIG. 4, the instant inventive Picatinny rail segment preferably has either a channel centered configuration (which is referred to generally by Reference Arrow 9) or ridge centered configuration (which is referred to generally by Reference Arrow 34). The central ridge of configuration 34 upwardly extends and is identified by Reference Numeral 51 in FIG. 4. Ridge 51 necessarily comprises the four central and proximal aspects of the V arms 36, 38, 40, and 42, and common intersecting portion of ridge 51 may be optionally removed for purposes of locating a vertically extending mounting screw eye (not depicted within views).

Similarly with the prior art Picatinny rail 1, both the channel centered configuration 9 and the ridge centered configuration 34 of the instant inventive Picatinny rail segment includes a left V arm (10 or 36, as the case may be), and a right V arm (12 or 38, as the case may be). In both of such configurations 9 and 34, its centered channel or ridge preferably closely matches a standardized channel or ridge appearing within a conventional or prior art Picatinny rail.

The channel centered configuration 9 further comprises a frontward and forwardly extending V arm 14 and a rear or rearwardly extending V arm 16. Correspondingly, the ridge centered configuration 34 further comprises a front V arm 40 and a rear V arm 42. In configuration 9, the front V arm 14 spans laterally between frontward ends of left and right V arms 10 and 12, and the rear V arm 16 similarly laterally expands between rearward ends of V arms 10 and 12. Similarly, in configuration 34, the front V arm 40 spans laterally between frontward ends of left and right V arms 36 and 38, while rear V arm 42 spans laterally between the rearward ends of those left and right V arms.

Each channel among the instant inventive Picatinny rail segment's channels (e.g., channels 20, 22, 46, 50, 48, and 49) opens upwardly and preferably further opens horizontally at an opposing pair of the V arms.

Figure 7:
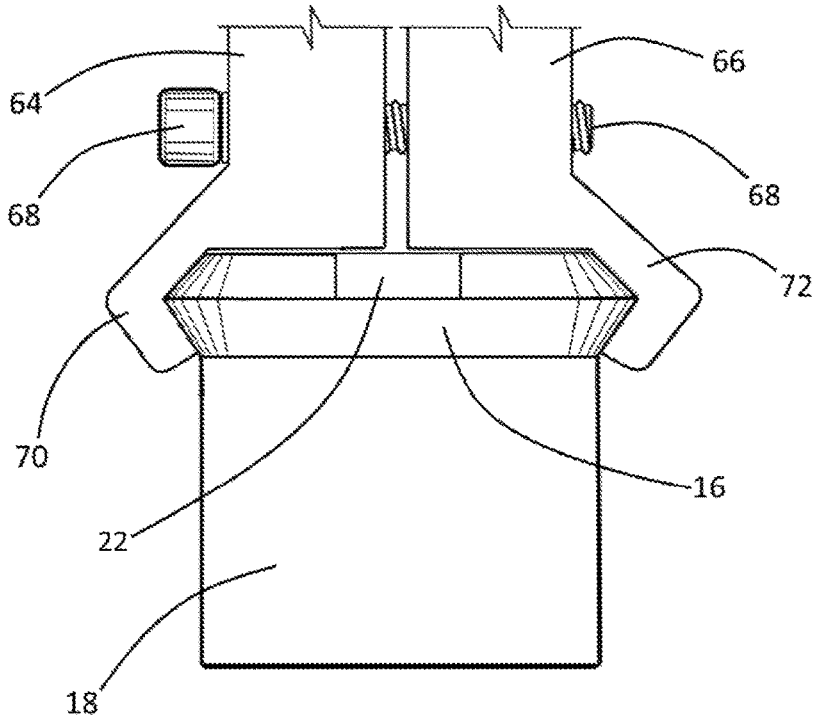
FIG. 7 presents a rear view of the structure depicted in FIG. 4, the view of FIG. 7 additionally showing an attachment of a firearm auxiliary component mounting bracket.
Figure 8:
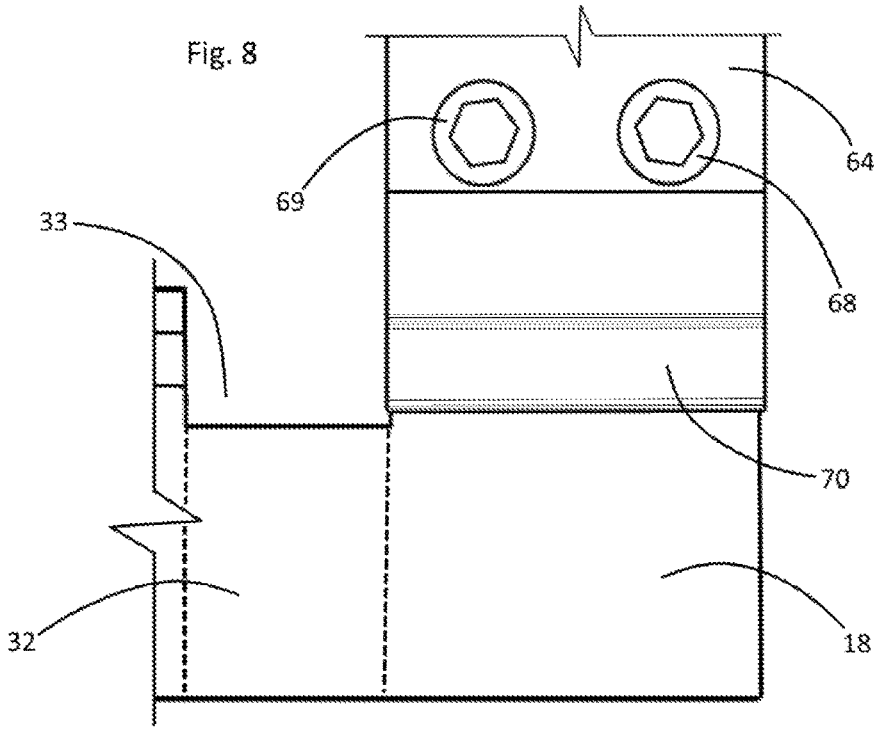
FIG. 8 presents a partial side view of the structure depicted in FIG. 6, the view including a side view of the mounting bracket of FIG. 7.
Figure 9:
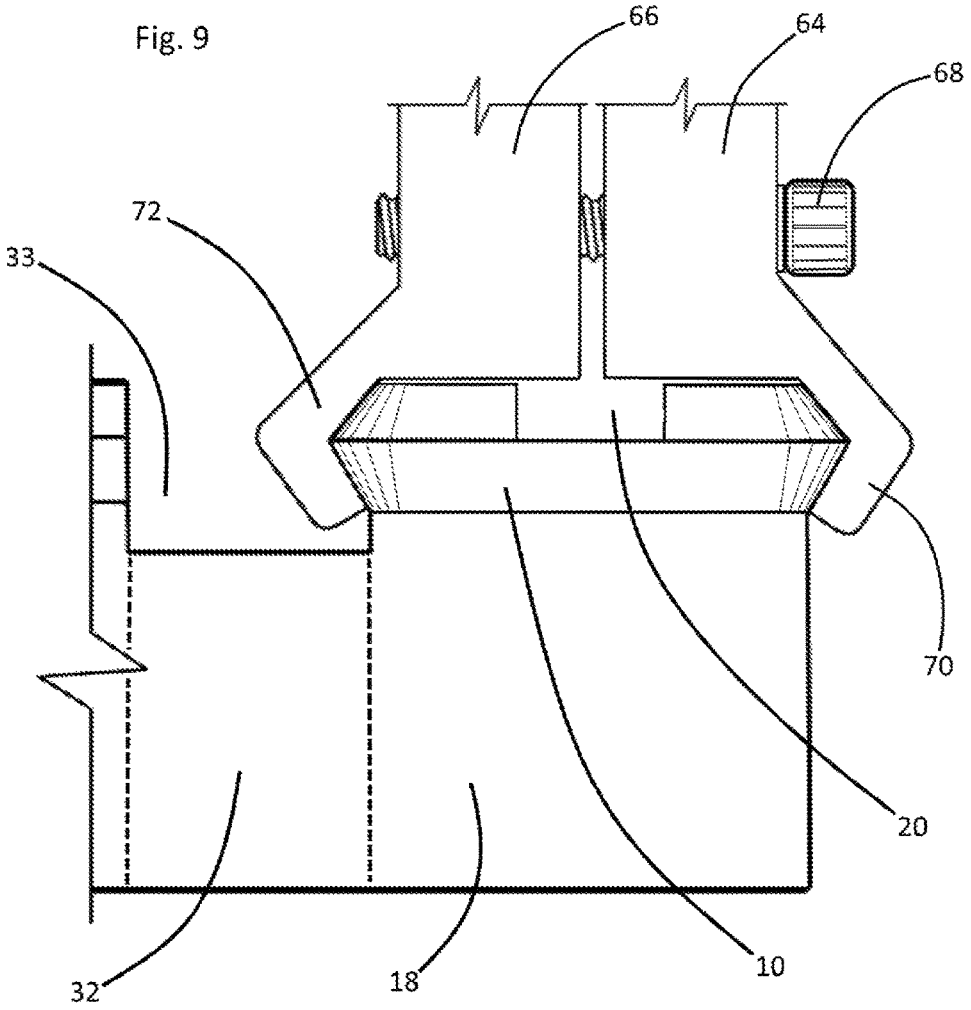
FIG. 9 redepicts the structure of FIG. 8, the view of FIG. 9 alternatively showing the mounting bracket of FIG. 7 rotated counter-clockwise 90°.
Figure 10:
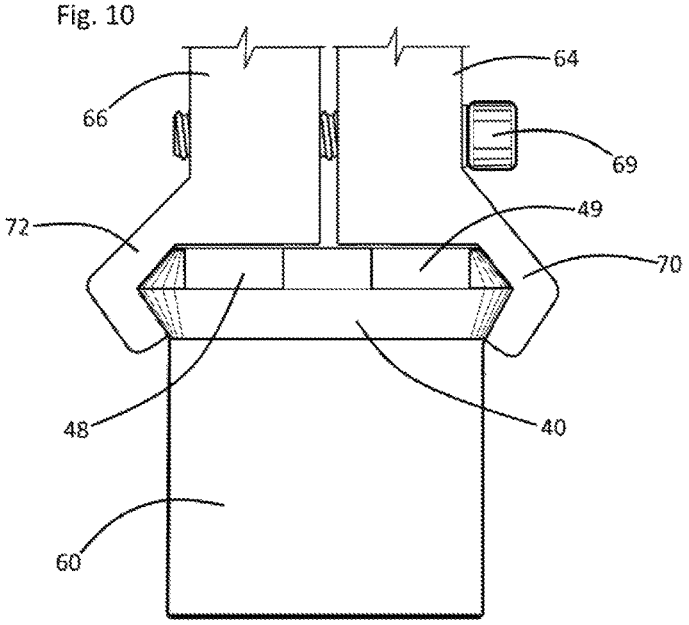
FIG. 10 presents a front view of the structure of FIG. 4, the view showing a mounting of the FIG. 9 bracket.
Figure 11:
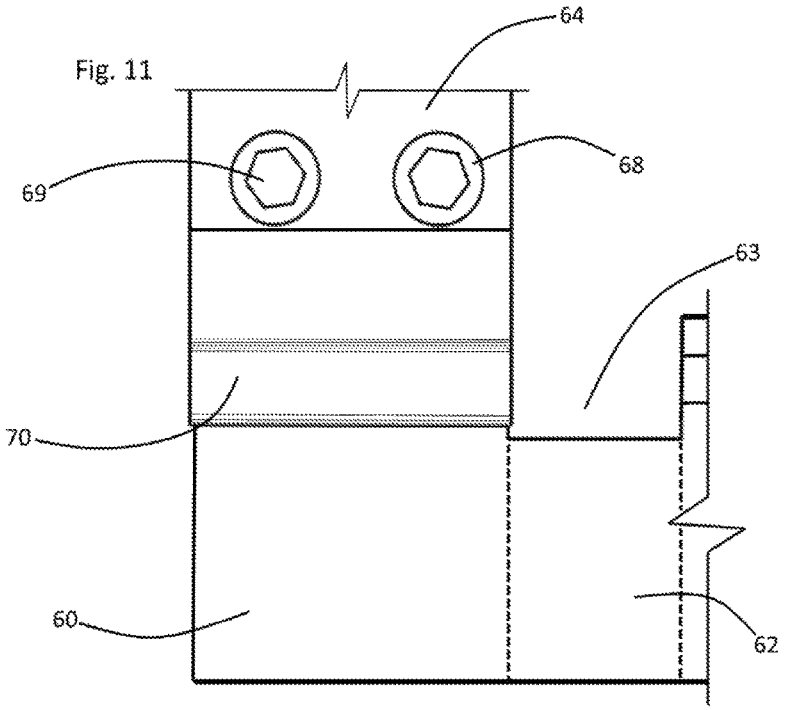
FIG. 11 presents an alternative partial side view of the structure depicted in FIG. 6, the view including a side view of the mounting bracket of FIG. 7.
Figure 12:
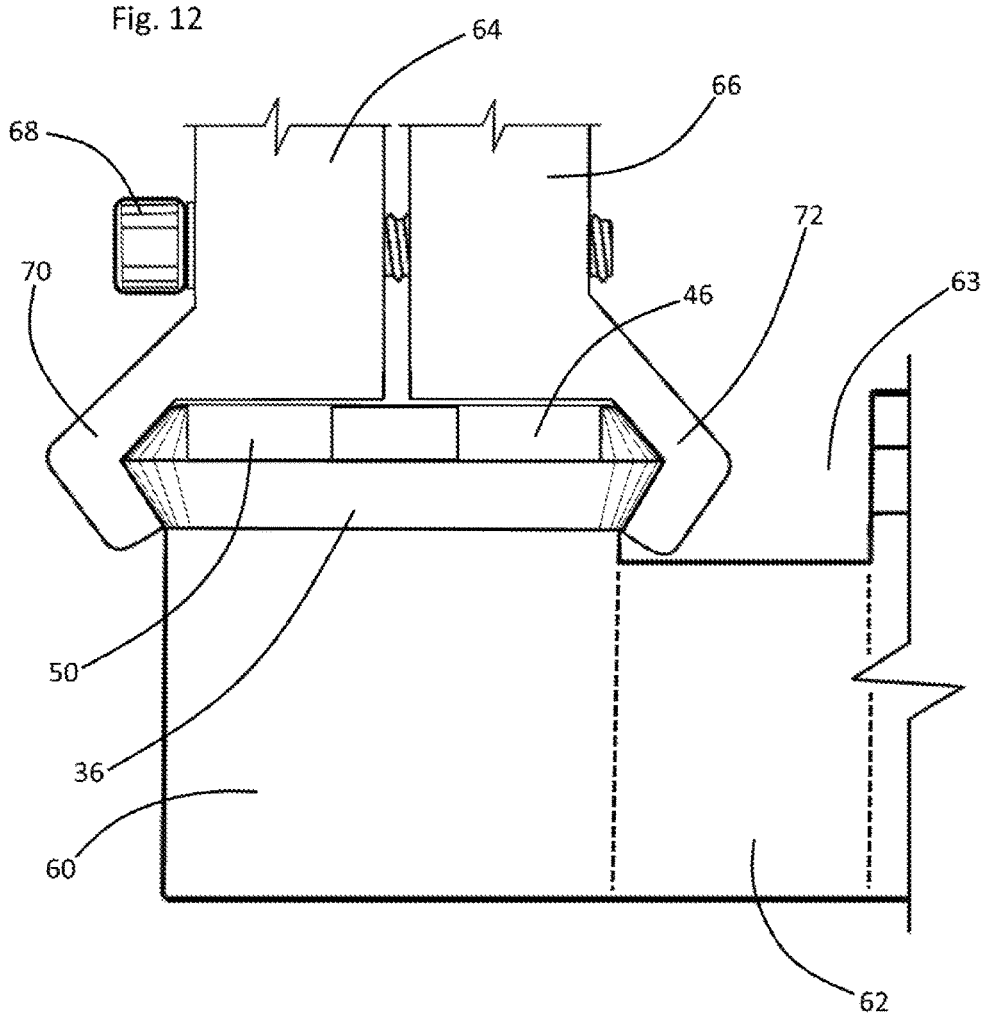
FIG. 12 redepicts the structure of FIG. 11, the view showing FIG. 11's mounting bracket rotated clockwise 90°.

In use of the instant inventive Picatinny rail segment, and referring in particular to Drawing FIGS. 4-8, an auxiliary firearm component having a caliper clamp type mounting bracket having left and right bracket halves 64 and 66 may be provided. Such bracket may be actuatable for clamping and unclamping via screws 68 and 69. Left and right Picatinny rail grasping jaws 70 and 72 are provided at the lower end of such bracket, such jaws 70 and 72 having V valleys fitted for nestingly receiving the Picatinny rail's left and right V arms. As indicated in FIGS. 7 and 8, such auxiliary component mounting bracket 64,66,70,72 may engage the channel centered Picatinny rail segment 9 in a leftward orientation, such orientation being representative of a rightward orientation which mirrors the FIG. 7 orientation. Further alternatively, such bracket 64,66,70,72 may engage the rail segment 9 in the rearward orientation of FIG. 9, such orientation being representative of an opposite mirroring forward orientation. Referring further simultaneously to FIGS. 10-12, such auxiliary component bracket 64,66,70,72 may similarly engage the ridge centered Picatinny rail segment 34 in the same four orientations (i.e., left and right orientations and front and rear orientations). Thus, such auxiliary component mounting caliper bracket may advantageously be selectively engaged with either of rail segments 9 and 34 in any of four orthogonal or 90° orientations.

Figure 13:
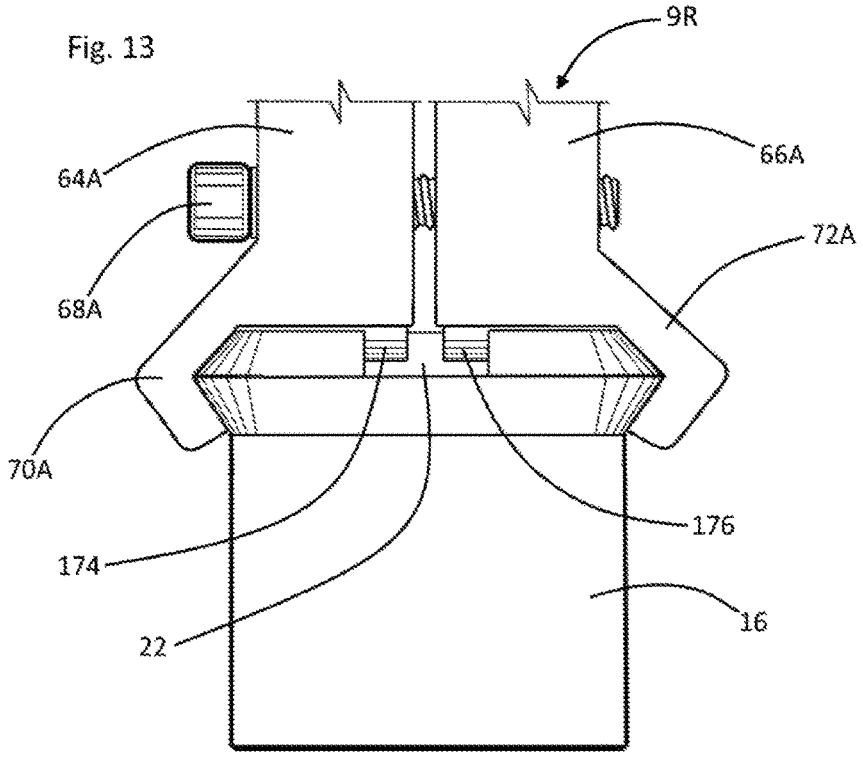
FIG. 13 redepicts the structure of FIG. 7, the view showing an attachment of an alternative mounting bracket.
Figure 14:
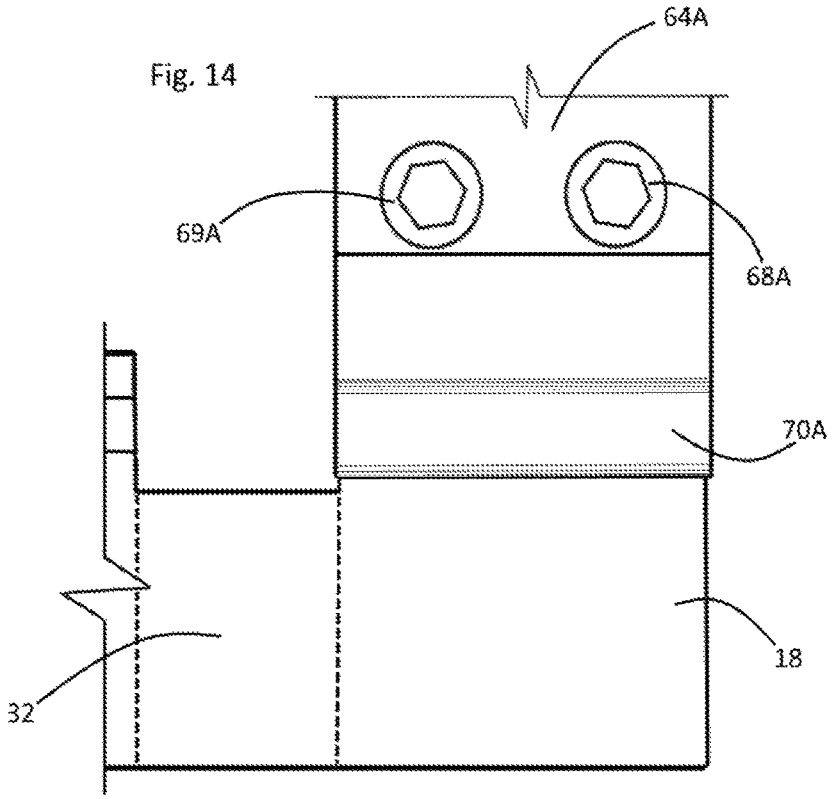
FIG. 14 redepicts the structure of FIGS. 8 and 9, the view showing a side view of the alternative mounting bracket of FIG. 13.
Figure 15:
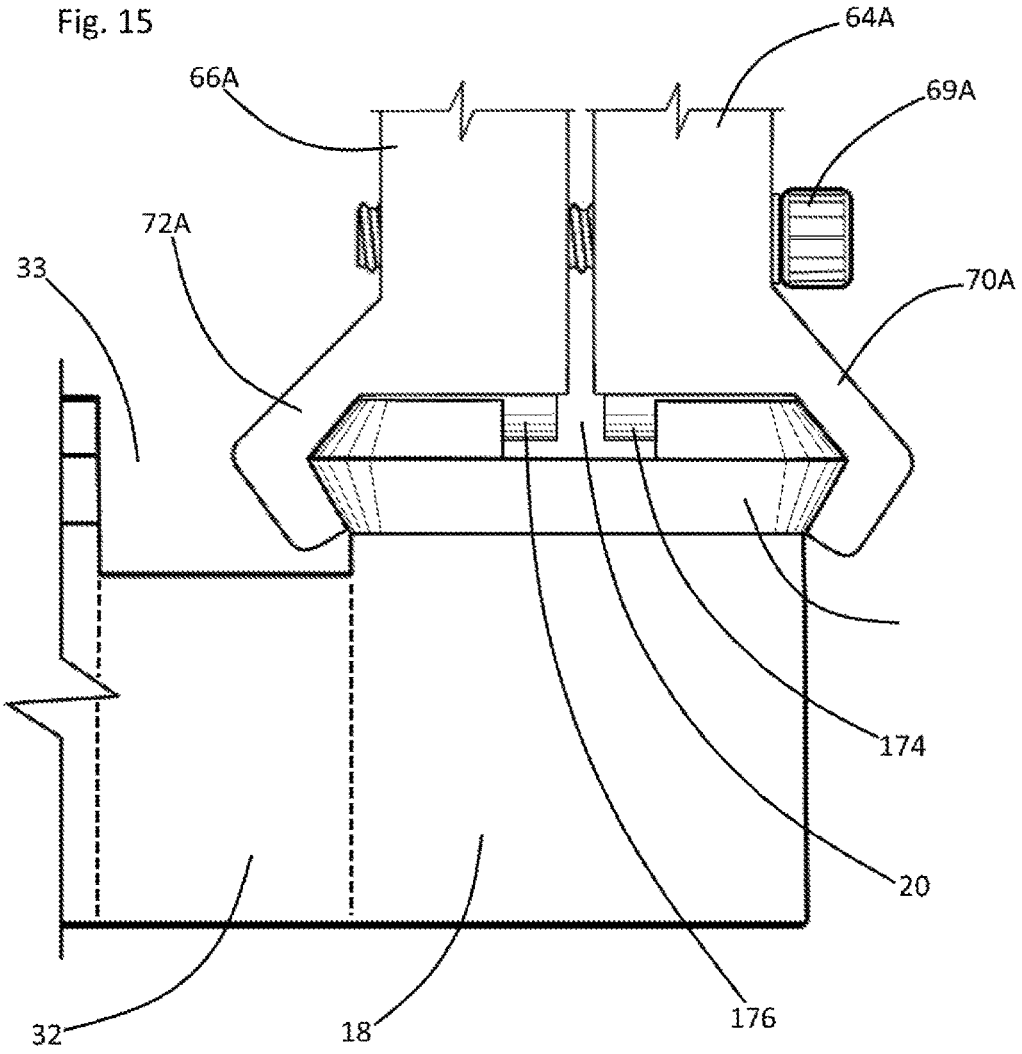
FIG. 15 redepicts the structure of FIG. 14, the view showing the alternative mounting bracket rotated counter-clockwise 90°.

Referring simultaneously to FIGS. 13-15, a caliper type Picatinny rail auxiliary component mounting bracket is configured similarly with the bracket 64,66,70,72 depicted in FIGS. 7-12, and reference numerals in Drawing FIGS. 13-15 having a suffix A identify structures which are substantially identical to similarly numbered structures appearing in FIGS. 7-12. The 64A,66A,70A,72A bracket variant differs from the bracket 64,66,70,72 of FIGS. 7-12 in that left jaw half 64A has a centrally positioned slide stopping ridge or protuberance 174, and the right jaw half 66A has a similarly configured and laterally aligned slide stopping protuberance 176. In mechanical relationship with the channel centered rail segment 9 upon which bracket 64A,66A, 70A,72A may be mounted, such bracket is correspondingly "ridge centered" and such bracket is referred to generally by Reference Arrow 9R.

In the leftward orientated installation of bracket 9R shown in FIG. 13, such bracket's centrally positioned protuberances or ridges 174 and 176 downwardly extend into and nestingly engage with lateral channel 20. Such engagement advantageously prevents any front to rear sliding motion of bracket 9R with respect to the Picatinny rail segment 9, and regardless of clamping pressure provided by screws 68A and 69A. As indicated in FIG. 15, bracket 9R and the auxiliary component it supports (not depicted within views) may be rotated 90° so that its ridges 174 and 176 alternatively downwardly nest segment 9's longitudinally intersecting channel 22. Such nesting engagement of ridges 174 and 176 within channel 22 advantageously prevents any lateral or left to right sliding motion of the installed auxiliary component with respect to Picatinny rail segment 9.

Figure 16:
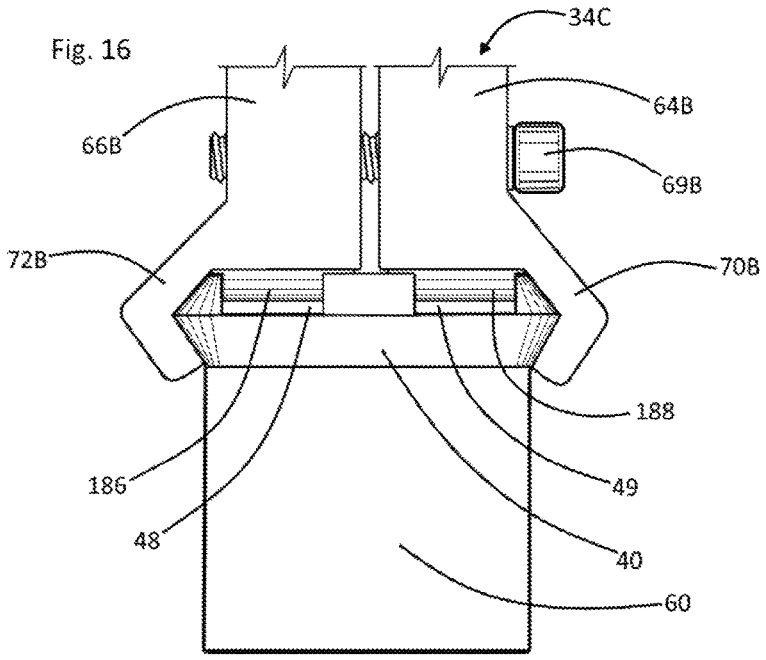
FIG. 16 redepicts the structure of FIG. 10, the view showing an attachment of a second alternative mounting bracket.
Figure 17:
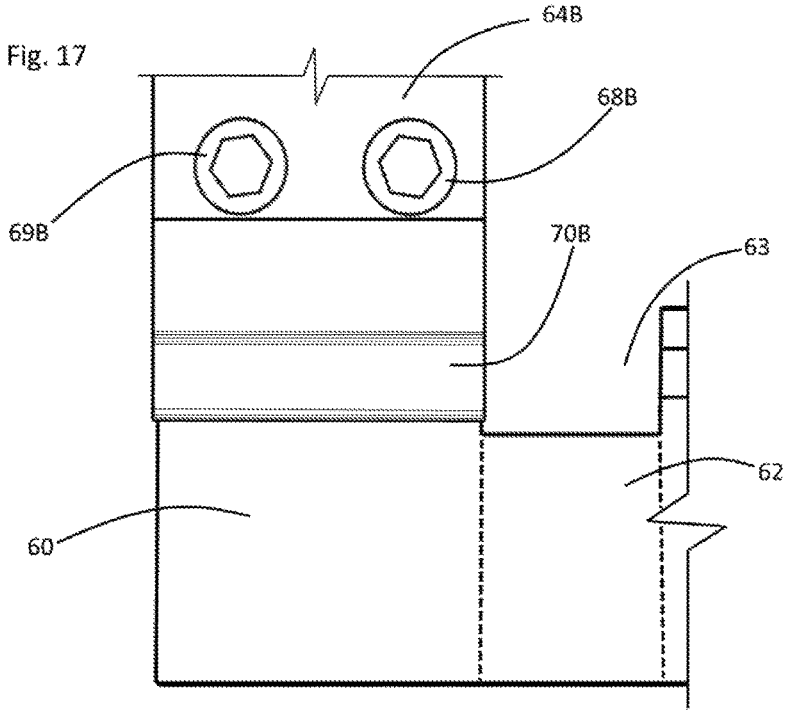
FIG. 17 redepicts the structure of FIGS. 11 and 12, the view showing a side view of the FIG. 16's second alternative mounting bracket.
Figure 18:
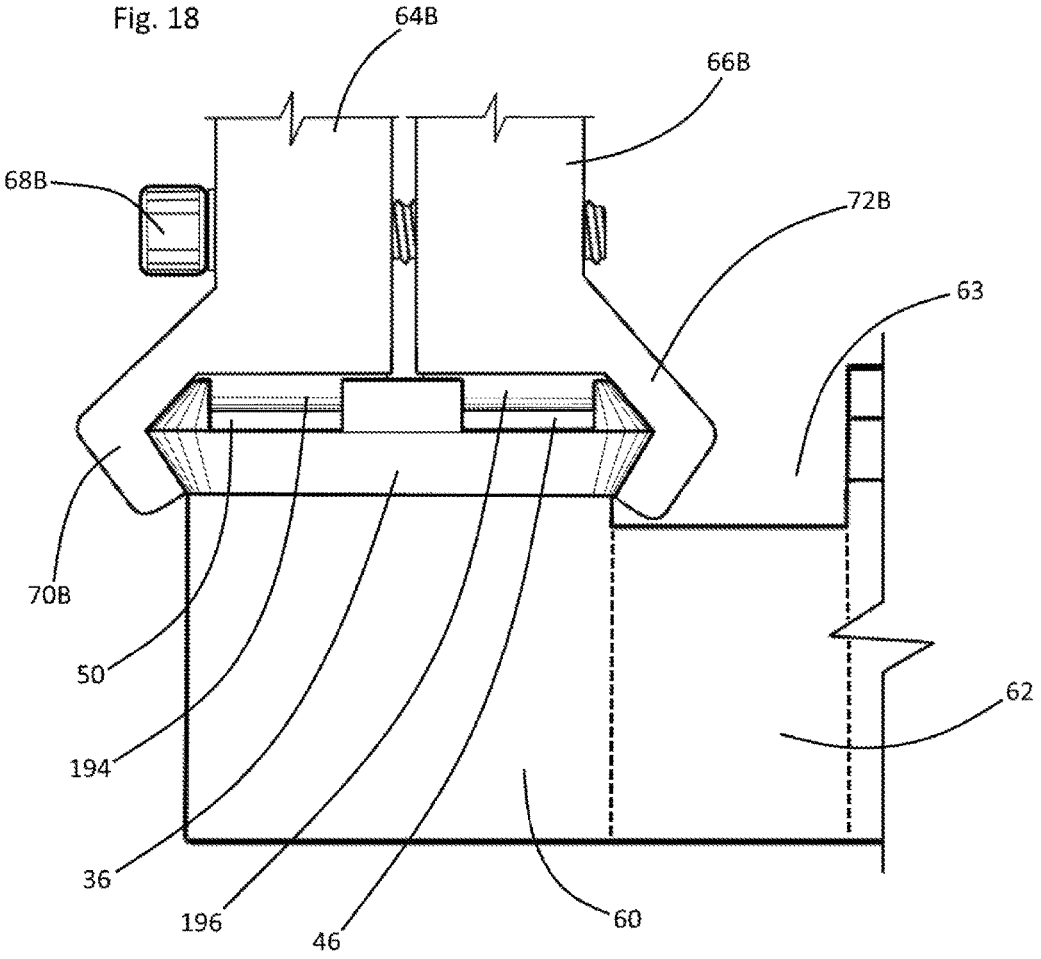
FIG. 18 redepicts the structure of FIGS. 11, 12, and 17, the view showing the second alternative mounting bracket rotated clockwise 90°.

Referring simultaneously to FIGS. 16-18, structures identified by reference numerals having the suffix "B" are configured substantially identically with similarly numbered structures appearing in Drawing FIGS. 7-12. The auxiliary component mounting bracket 64B,66B,70B,72B differs from the 9R bracket depicted in Drawing FIGS. 13-15 in that the 64B,66B,70B,72B bracket presents paired or front and rear protuberances or ridges 188 and 194 which extend downwardly from the left bracket half 64B and presents paired or front and rear ridges 186 and 196 which extend downwardly from the right bracket half 66B. Such pairing of ridges effectively frontwardly and rearwardly bounds a central and downwardly opening channel which spans laterally between jaws 70B and 72B. The formation of such central channel makes its bracket amenable for attachment to Picatinny rail segments of the ridge centered type 34. Accordingly, such channel centered bracket type is referred to generally by reference arrow 34C.

Upon installation of bracket 34C in the leftward orientation of FIG. 16, ridges 186 and 188 downwardly nest within the laterally extending channel 50 of the ridge centered Picatinny rail segment 34, while the rearwardly adjacent pair of ridges 194 and 196 similarly downwardly nest within lateral channel 46. Such nesting receipts of such ridges within parallel lateral channels 50 and 46 advantageously resists any front to rear sliding motion of bracket 34C with respect to rail segment 34. In the 90° rotated installation configuration of FIG. 18, the ridges 186, 188, 194, and 196 are similarly nestingly received within longitudinally extending, parallel, and intersecting channels 48 and 49 for resisting any lateral sliding motion with respect to rail segment 34.

The caliper type Picatinny rail mounting bracket 64,66, 70,72 of FIGS. 7-12, combined with the single slide stopping ridge and paired slide stopping ridge variants 9R and 34C shown in FIGS. 13-18, represents a substantial portion of all brackets adapted for mounting upon a conventional Picatinny rail segment. Yet, the conventional configurations of such rail segments undesirably impose a 180° or bidirectional mounting restriction upon substantially all components which are mounted by such rail segments. The instant inventive Picatinny rail segment capably engages all of the brackets, and for each advantageously doubles the number of mounting orientations which may be selected.

Referring to FIGS. 4-12, each Picatinny rail segment 9 or 34, as the case may be, comprises a fixedly attached and downwardly extending base 18 or 60. Such base 18 or 60, as the case may be, is preferably substantially square and is fitted to underlie V arms 10,12,14,16 or 36,38,40,42. Alternatively, such bases 18 and 60 may comprise a forward extension section 32 or a rearward extension section 62. As is depicted in FIG. 4, the forward extension section 32 may advantageously connect with and cause segment 9 to be integral with a length of conventionally configured Picatinny rail having standardized ridges 15 and channels 13, while providing an upwardly opening caliper jaw clearance space 33. The rearward extension 62 functions similarly with respect to rail segment 34, alternatively integrating that segment with the front end of the conventional length of Picatinny rail and providing a jaw clearance space 63.

In the preferred embodiment, each of the instant invention's V arms 10,12,14,16 and 36,38,40,42, as the case may be, has a pair of ends which meet at substantially 90° corners with two other V arms. Each such corner is preferably curved or arcuately relieved, such curved corner transitions advantageously allowing for sliding and snag free engagements with auxiliary component mounting brackets, while preventing any presentation of sharp cutting corners.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A segment of a Picatinny rail, the Picatinny rail having front and rear ends, left and right sides, and upper and lower sides, said segment comprising:

(a) a left T arm having a front end and a rear end;
(b) a right T arm having a front end and a rear end;
(c) a front T arm spanning between the front ends of the left and right T arms; and
(d) a rear T arm spanning between the rear ends of the left and right T arms.

2. The Picatinny rail segment of claim 1 further comprising a first upwardly opening channel, said channel further opening leftwardly and rightwardly at the left and right T arms.

3. The Picatinny rail segment of claim 2 further comprising a second upwardly opening channel, said channel intersecting the first upwardly opening channel, and said channel further opening frontwardly and rearwardly at the front and rear T arms.

4. A segment of a Picatinny rail, the Picatinny rail having front and rear ends, left and right sides, and upper and lower sides, said segment comprising:

(a) a left V ridge having a front end and a rear end;
(b) a right V ridge having a front end and a rear end;
(c) a front V ridge spanning between the front ends of the left and right V ridges; and
(d) a rear V ridge spanning between the rear ends of the left and right V ridges;
(e) a first upwardly opening channel, said channel further opening leftwardly and rightwardly at the left and right V ridges;

(f) a second upwardly opening channel, said channel intersecting the first upwardly opening channel, and said channel further opening frontwardly and rearwardly at the front and rear V ridges; and (g) a third and a fourth upwardly opening channel, said channels respectively paralleling the first and second upwardly opening channels.

5. The Picatinny rail segment of claim 3 wherein the first and second upwardly opening channels are respectively substantially centered between the left and right T arms, and between the front and rear T arms.

6. The Picatinny rail segment of claim 4 wherein the first and third upwardly opening channels form a first upwardly extending ridge therebetween, and wherein the second and fourth upwardly opening channels form a second upwardly extending ridge therebetween.

7. The Picatinny rail segment of claim 6 wherein the first and second upwardly extending ridges are respectively substantially centered between the left and right V ridges and between the front and rear V ridges.

8. The Picatinny rail segment of claim 5 wherein each T arm end forms a curved transition.

9. The Picatinny rail segment of claim 7 wherein each V ridge end forms a curved transition.

10. A segment of a Picatinny rail, the Picatinny rail having front and rear ends, left and right sides, and upper and lower sides, said segment comprising:

(a) a left V ridge having a front end and a rear end;

(b) a right V ridge having a front end and a rear end;

(c) a front V ridge spanning between the front ends of the left and right V ridges; and (d) a rear V ridge spanning between the rear ends of the left and right V ridges;

(e) a first upwardly opening channel, said channel further opening leftwardly and rightwardly at the left and right V ridges;

(f) a second upwardly opening channel, said channel intersecting the first upwardly opening channel, and said channel further opening frontwardly and rearwardly at the front and rear V ridges, wherein the first and second upwardly opening channels are respectively substantially centered between the left and right V ridges and between the front and rear V ridges; and (g) a substantially square base fixedly attached to and extending downwardly from the left, right, front, and rear V ridges.

11. The Picatinny rail segment of claim 10 further comprising a base extension fixedly attached to and extending frontwardly or rearwardly from the substantially square base.

12. The Picatinny rail segment of claim 7 further comprising a substantially square base fixedly attached to and extending downwardly from the left, right, front, and rear V ridges.

13. The Picatinny rail segment of claim 12 further comprising a base extension fixedly attached to and extending frontwardly or rearwardly from the substantially square base.

* * * * *